United States Patent [19]

Fried

[11] 3,998,567

[45] Dec. 21, 1976

[54] PRESSURE EXCHANGER CELL RING AND IMPROVED CELL WALL CONSTRUCTION THEREFOR

[75] Inventor: Reinhard Fried, Nussbaumen, Switzerland

[73] Assignee: BBC Brown Boveri & Company Limited, Baden, Switzerland

[22] Filed: June 26, 1975

[21] Appl. No.: 590,685

[30] Foreign Application Priority Data

July 11, 1974 Switzerland ..... 9561/74

[52] U.S. Cl. ..... 416/189; 417/64; 416/242

[51] Int. Cl.[2] ..... F04D 29/26

[58] Field of Search ..... 417/64; 416/189, 190, 416/242; 29/156.8 B

[56] References Cited

UNITED STATES PATENTS

| | | | |
|---|---|---|---|
| 3,101,168 | 8/1963 | Berchtold | 417/64 |
| 3,363,832 | 1/1968 | Groff | 416/190 |
| 3,458,116 | 7/1969 | Winkler et al. | 417/64 |
| 3,545,882 | 12/1970 | Williamson | 416/190 |
| 3,745,629 | 7/1973 | Pask et al. | 29/156.8 B |

FOREIGN PATENTS OR APPLICATIONS

| | | | |
|---|---|---|---|
| 1,077,365 | 7/1967 | United Kingdom | 416/189 |

*Primary Examiner*—Everette A. Powell, Jr.
*Attorney, Agent, or Firm*—Werner W. Kleeman

[57] ABSTRACT

A pressure exchanger cell ring comprising a rotor which, viewed in cross-section, possesses cell walls of at least double curvature, each of the cell walls being secured at its ends to the hub and shroud, respectively, of the rotor. Each cell wall is shaped to have protruding portions or lobes, each curving to either side of a radius extending through one of both attachment locations of the cell wall. The sector angle enclosed between the two radii extending from the center of the rotor through each attachment location of a cell wall does not exceed 4°, and the sector angle bounding the mean camber line of the cell wall does not exceed 7°.

14 Claims, 1 Drawing Figure

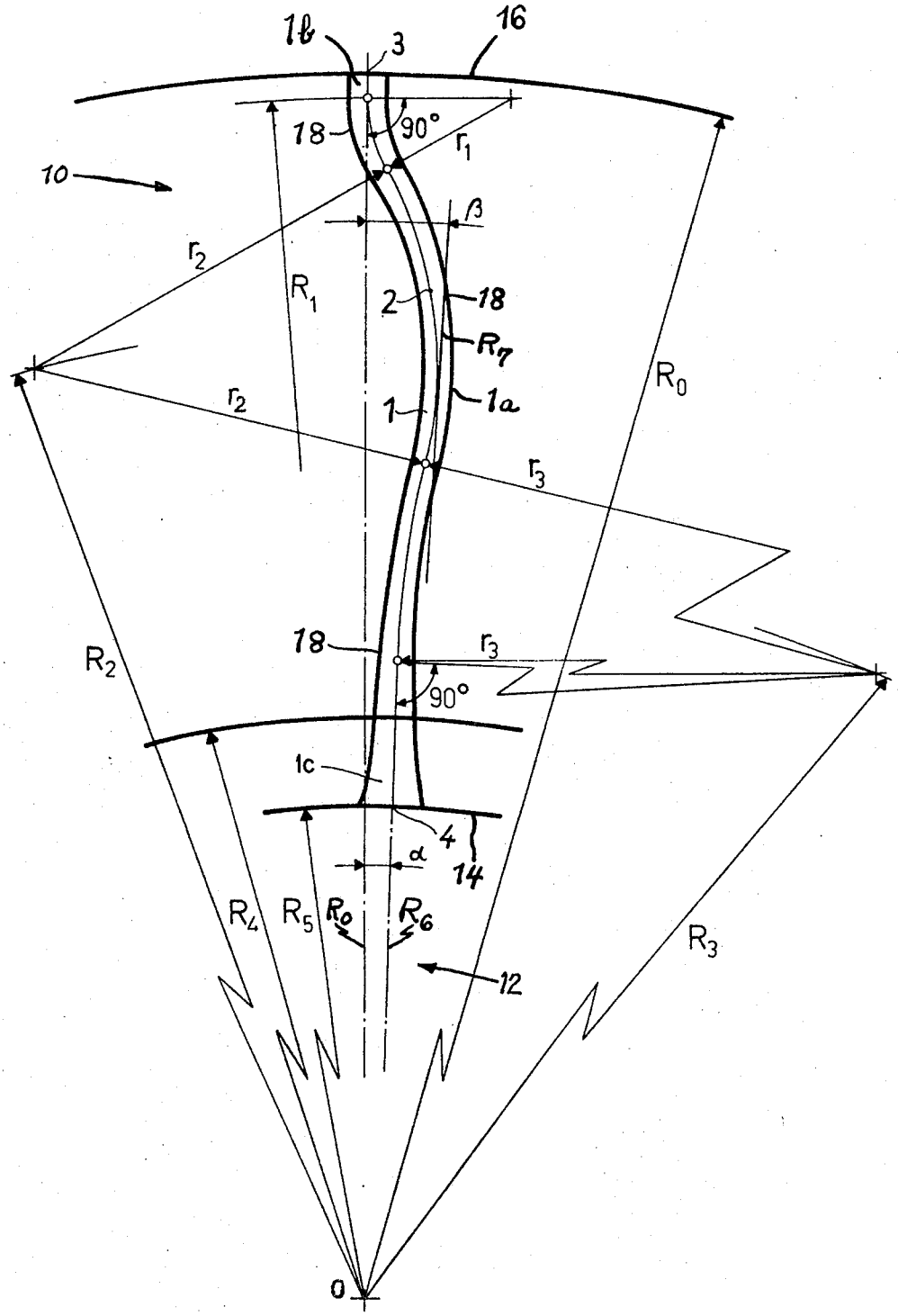
1b
3
16
18
90°
r1
10
β
r2
R1
2
18
R7
R0
r2
1
1a
r3
18
r3
R2
90°
1c
4
14
α
R4
R5
R0
R6
R3
12
0

PRESSURE EXCHANGER CELL RING AND IMPROVED CELL WALL CONSTRUCTION THEREFOR

BACKGROUND OF THE INVENTION

The present invention relates to a new and improved construction of a pressure exchanger cell ring—also referred to in the art as a gas-dynamic pressure wave machine—which is of the type wherein the rotor thereof, when viewed in cross-section, possesses cell walls of at least double curvature which are attached to the hub and shroud of the rotor, and each cell wall curves to both sides of a radius extending from the center of the rotor through one of the two attachment points or locations of the cell wall. The invention further relates to a novel construction of cell wall for use in a pressure exchanger cell ring.

A pressure exchanger cell ring has been disclosed in British Pat. No. 1,077,365, published July 26, 1967, which, when viewed in cross-section, possesses doubly curved cell walls, wherein the two surfaces enclosed by the means camber line and the chord line joining the two points of attachment, and which points of attachment are not located along a radius extending through the center of the rotor, are identical. The teaching of this patent is significantly silent as to how pronounced the curvatures of the lobe or curved portions should be, or may be, and equally as to what would be a maximum permissible value of the spacing between the mean camber line and the chord or connecting line. Cell walls of this type provide certain beneficial operating characteristics as concerns the thermal stresses which arise, yet no consideration is given to the quite appreciable mechanical stresses caused by centrifugal forces and exerted in the cell walls and at their attachment points or locations.

Furthermore, a pressure exchanger cell ring has been taught in Swiss Pat. No. 458,839 possessing a construction wherein, each cell wall, viewed in cross-section, curves to either side of the radius passing through at least one of its two points of attachment. These curved portions are coordinated to one another in a manner such that for the attachment point or location lying on the radius the resultant centrifugal moment is aproximately null. This is also true for both points of attachment provided that they are located on the same radius, yet in this case the thermal stresses are considerable. If the cell wall is curved to each side of the radius passing through only one of the points of attachment, then, while the thermal stresses in the cell wall are very small, nonetheless the mechanical stresses at the other attachment point or location are high and the restoring forces acting upon the cell wall are considerable. This patent is equally notably silent as to maximum permissible curvature values of the curved portions or lobes.

SUMMARY OF THE INVENTION

With the foregoing in mind, it is therefore a primary object of the present invention to provide an improved construction of pressure exchanger cell ring possessing cell walls novelly configured to realize extremely favorable stress distribution.

Another and more specific object of the present invention aims at imparting to the cell walls of a pressure exchanger cell ring,—and which cell walls have at least a double curvature when viewed in cross-section— a configuration such that the sum of the total stresses appearing in the hub, the shroud and the cell walls are balanced-out or compensated to a large degree, and consequently, there is avoided the presence of any peak stress values.

Yet a further noteworthy object of the present invention relates to the provision of a new and improved construction of cell wall affording favorable operating conditions when employed in a pressure exchanger cell ring and providing advantageous stress distribution and increased service life of the cell wall.

Now in order to implement these and still further objects of the invention, which will become more readily apparent as the description proceeds, the invention contemplates that the pressure exchanger cell ring of this develoment possesses cell walls, wherein each cell wall has the sector angle thereof not exceeding 4°, this sector angle being defined by the angle between two radii extending from the center of the rotor through the respective points of attachment of the cell wall to the hub and shroud respectively, and wherein the sector angle bounding the mean camber line of the cell wall does not exceed 7°.

With a construction of pressure exchanger cell ring conforming to these conditions differences in expansion, due to temperature, between the hub, shroud and cell walls, only cause small stresses. Stresses brought about by centrifugal forces in the cell walls are beneficially distributed in such a manner that they are approximately of the same magnitude throughout the height of each cell wall, even if such stresses have different sign. It is therefore not possible for the stresses in the cell walls near their one respective point or location of attachment to be approximately null and near their other respective attachment point to assume a maximum value. The stresses in the hub and in the shroud close to the points of attachment of the cell walls are also beneficially of approximately the same magnitude as in the cell walls.

The invention also relates to a new and improved construction of cell wall for use in a pressure exchanger cell ring, which cell wall comprises a cell wall member curved at least twice to define at least two lobes or protruding portions between the opposed ends of the cell wall which are intended to be secured to a hub and shroud of a rotor of the pressure exchanger cell ring. Each lobe is curved to one side of a radius passing through one of its points of attachment, and the sector angle enclosed between two radii passing through the two points of attachment of the cell wall does not exceed 4°, and the sector angle bounding the mean camber line of the cell wall does not exceed 7°.

In the disclosure of the invention as given herein the sector angle enclosed between two radii passing through the two points of attachment of the cell wall has been designated as the "sector angle $\alpha$". As mentioned above, this sector angle $\alpha$ should not exceed 4°, and may be in a range of 0° to 4°, an extremely advantageous value thereof amounting to about 1° 40′.

The sector angle bounding the mean camber line of the cell wall has been designated herein as the "sector angle $\beta$". In the embodiment of the invention under discussion, this sector angle $\beta$ is the angle enclosed between the radius extending from the center of the rotor through the point or location of attachment of the cell wall with the shroud and the radius extending from the rotor center tangentially with respect to the means camber line of the cell wall. Also as mentioned above, this sector angle $\beta$ should not exceed 7°, and may lie within a range of 0.5° to 7°, a preferred value being in the order of approximately 4°.

Of course, within the indicated limits a large number of different mean camber lines ae possible and the stresses which arise correspondingly vary. However, all of the cell wall shapes, while taking into account the underlying principles of the invention, advantageously possess the characteristic that the stresses are adequately compensated or balanced and thus closely approximately the minimum attainable values.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE illustrates an exemplary embodiment of a cell wall of a pressure exchanger cell ring designed according to the teachings of the present invention.

DETAILED DESCRIPTION OF THE PREFERRED EMBODIMENTS

Referring now to the drawing, it is to be understood that in the single illustrated FIGURE thereof there has only been shown enough of a pressure exchanger cell ring, generally indicated by reference character 10, and designed according to the teachings of the present invention, to enable those skilled in the art to readily understand the underlying concepts. For purposes of simplification of the illustration there is shown an exemplary embodiment of a cell wall 1 which is designed to possess an extremely favorable form as concerns stress distribution. As is quite well known in this particular field of technology a pressure exchanger cell ring consists of a number of spaced cell walls which extend between an inner hub member and an outer shroud member of a rotor. Hence, since the cell walls 1 of this development generally may be all of the same design it will be sufficient to consider a single cell wall, the comments made in respect thereof being equally applicable to the other cell walls.

In the embodiment under discussion, the rotor has only been schematically indicated by reference character 12, its hub or hub member by reference character 14, and the shroud or shroud member by reference character 16. Between the hub 14 and the shroud 16 there extends in spaced relationship about the rotor 12 a plurality of such cell walls 1. Each cell wall 1 defines a cell wall member 1*a* which is suitably connected in conventional fashion at opposed ends 1*b* and 1*c* at the attachment points or locations 3 and 4 with the shroud 16 and hub 14 respectively. Further, each cell wall possesses at least a double-curved construction, and, in the exemplary embodiment under discussion, each such cell wall 1 is curved for istance three times to define the protruding portions or lobes 18. Each lobe 18 curves to one side of a radius extending from the center 0 of the rotor 12 to one of the points of attachment of the cell wall, such as for instance the radius $R_6$ extending through the point of attachment 4 of such cell wall 1 at the hub member 14 of the rotor 12. As also will be discussed hereinafter, the hub 14 may be located at a radius $R_5$ from the center 0 of the rotor 12, or at some other suitably selected radius, such as the radius $R_4$, in which case then the attachment point or location 4 would be correspondingly shifted, as will be readily apparent to those versed in this art.

As previously mentioned, the sector angle enclosed between the two radii $R_0$ and $R_6$ extending from the center 0 of the rotor 12 through the attachment points 3 and 4 of the cell wall 1 is designated by the symbol $\alpha$, and the sector angle bounding the mean camber line 2 of such cell wall 1 is designated by the symbol $\beta$ and is as defined heretofore. The radius which extends from the rotor center 0 tangentially to the mean camber line 2 has been designated by reference character $R_7$ and together with the radius $R_0$ encloses such sector angle $\beta$. The constructional values for the means camber line 2 are governed by the following considerations, it being understood that the radius $R_0$ of te attachment point 3 of the cell wall 1 at the shroud 16 is considered as equal to 100%.

a. the mean camber line 2 extends radially up to a radius $R_1$ of 98%.
b. adjoining such is an arc having a radius of curvature $r_1$ of 9%;
c. this arc is followed by an arc curved in the opposite direction, the center of which is at a radius $R_2$ of 84% and its radius of curvature $r_2$ amounts to 25%;
d. adjoining such arc is an arc extending in the opposite direction, the center of this arc being at a radius $R_3$ of 87% while its radius of curvature $r_3$ is 60%;
e. this last-mentioned arc is followed by a radius extending to a radius amounting to between 60 to 50%, depending upon the selected hub radius which may be the radius $R_4$ or $R_5$.

Of course, it is to be expressly understood that it is not absolutely necessary to strictly maintain these values in order to achieve the favorable characteristics of the cell wall 1; they are to be considered as guidelines or indicative values. If the mean camber line 2 is chosen such that it lies within 1% of the shroud radius $R_0$ of the shroud 16 to both sides of the mean camber line 2 as defined above, then it can be still considered to be extremely good. The maximum values of 4° for the sector angle $\alpha$ and 7° for the sector angle $\beta$ are not thereby exceeded.

If the partition walls are formed of sheet metal then their thickness is of course uniform throughout. However, if, for instance, the rotor is cast, then there is afforded the opportunity of designing the cell wall for a greater loading capacity. This is achieved in that, starting from one attachment point or location, the thickness of the cell wall progressively descreases in the radial direction and upon reaching a minimum value again progressively increases towards the other attachment point or location. Extensive calculations have shown that it is advantageous if the thickness of the cell wall close to the point of attachment at the hub amounts to three times the minimum thickness of said cell wall and twice such minimum thickness at the region close to the point of attachment at the shroud.

While there is shown and described present preferred embodiments of the invention, it is to be distinctly understood that the invention is not limited thereto, but may be otherwise variously embodied and practiced within the scope of the following claims.

What is claimed is:

1. A pressure exchanger cell ring comprising a rotor having a hub, a shroud spaced from said hub, cell walls connected with and extending between said hub and shroud, each cell wall possessing at least a double-curved construction defining at least two lobes, each lobe curving to one side of a radius extending from the center of the rotor to one of the points of attachment of the cell wall, the sector angle between two radii extending from the center of the rotor through the points of attachment of the cell wall not exceeding 4°, said cell wall having a mean camber line, said mean camber line being bounded by a sector angle which does not exceed 7°, said value limits of the sector angles serving to essentially compensate the sum of the total stresses appearing in the hub, shroud and cell walls, in order to thereby substantially avoid the presence of any peak stress values.

2. The pressure exchanger cell ring as defined in claim 1, wherein the mean camber line of the cell wall is defined by the following constructional values, starting at the point of attachment of the cell wall with the shroud, wherein the radius $R_0$ from the center of the rotor to the shroud is taken as 100%, and all of the following values being related thereto as follows:

a. the mean camber line of the cell wall extends radially to a radius $R_1$ which amounts to 98% of $R_0$;
b. adjoining the mean camber line extending to the radius $R_1$ is a first arc having a radius of curvature $r_1$ amounting to 9% of $R_0$;
c. adjoining the first arc is a second arc which is curved in the opposite direction, said oppositely curved second arc having a center of curvature located at a radius $R_2$ from the center of the rotor, said radius $R_2$ amounting to 84% of the radius $R_0$ and its radius of curvature $r_2$ amounting to 25% of the radius $R_0$;
d. adjoining the second arc is a third arc which is curved in the opposite direction, said third arc having a center of curvature located at a radius $R_3$ from the rotor center 0, this radius $R_3$ amounting to 87% of the radius $R_0$ and having a radius of curvature $r_3$ which amounts to 60% of the radius $R_0$;
e. following said third arc is a radius which extends to a radius having a value between 60 and 50% of the radius $R_0$, depending upon the selected radius of the hub.

3. The pressure exchanger cell ring as defined in claim 2, wherein the values of features (a) to (e) can be varied to an extent such that the actual mean camber line lies within 1% to either side of the mean camber line defined by the features (a) to (e).

4. The pressure exchanger cell ring as defined in claim 1, wherein the thickness of the cross-section of the cell wall varies over the radial extend thereof, the thickness of the cell wall beginning at one attachment point progressively decreasing until reaching a minimum value and after reaching said minimum value the cell wall thickness again progressively increases towards the other attachment point.

5. The pressure exchanger cell ring as defined in claim 4, wherein the thickness of the cell wall close to its point of attachment with the hub is approximately three times the value of the minimum thickness of said cell wall and at the region in close proximity to the point of attachment at the shroud is approximately twice the value of the minimum cell wall thickness.

6. The pressure exchanger cell ring as defined in claim 1, wherein the sector angle bounding the mean camber line of the cell wall is defined by the angle enclosed between a radius extending from the center of the rotor through the point of attachment of the cell wall with the shroud and a radius extending from the rotor center tangentially to the mean camber line, said sector angle being in a range of about 0.5° to a maximum of 7°.

7. The pressure exchanger cell ring as defined in claim 6, wherein the sector angle bounding the mean camber line amounts to about 4°.

8. The pressure exchanger cell ring as defined in claim 1, wherein said sector angle between said two radii is in a range of 0° to 4°.

9. The pressure exchanger cell ring as defined in claim 8, wherein said sector angle between said two radii amounts to about 1° 40′.

10. A cell wall for use in a pressure exchanger cell ring, said cell wall comprising a cell wall member which is curved at least twice to define at least two lobes between opposed ends of the cell wall which are intended to be secured to a hub and shroud of a rotor of the pressure exchanger cell ring, each lobe being curved to one side of a radius passing through one of its points of attachment, and wherein the sector angle enclosed between two radii passing through the two points of attachment of the cell wall does not exceed 4°, the sector angle bounding the mean camber line of the cell wall does not exceed 7°, said sector angle bounding the mean camber line of the cell wall comprising the angle enclosed between a radius extending through the point of attachment with the shroud and a radius extending tangentially to the mean camber line, said two value limits of said sector angles serving to essentially compensate the sum of the total stresses appearing in the hub, shroud and cell walls, in order to thereby substantially avoid the presense of any peak stress value.

11. The cell wall as defined in claim 10, wherein said sector angle being in a range of about 0.5° to a maximum of 7°.

12. The cell wall as defined in claim 11, wherein the sector angle bounding the mean camber line amounts to about 4°.

13. The cell wall as defined in claim 10, wherein said sector angle between said two radii is in a range of 0° to 4°.

14. The cell wall as defined in claim 13, wherein said sector angle between said two radii amounts to about 1° 40′.

* * * * *